US006502263B1

(12) United States Patent
Rowley et al.

(10) Patent No.: US 6,502,263 B1
(45) Date of Patent: Jan. 7, 2003

(54) SEAT CUSHION AND POSITIONING ASSEMBLY INCLUDING INFLATABLE AIR CELL PRESSURE COMPENSATION INSERT

(75) Inventors: Judy Rowley, Kitchener (CA); Jamison Float, Westerville, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/915,637

(22) Filed: Jul. 26, 2001

(51) Int. Cl.[7] ..... A47C 27/18; A47C 7/02

(52) U.S. Cl. ..... 5/654; 5/653; 5/655.3; 297/452.41; 297/452.25

(58) Field of Search ..... 5/654, 655.3, 653, 5/644; 297/452.21, 452.22, 452.23, 452.24, 452.25, 452.26, 452.41

(56) References Cited

U.S. PATENT DOCUMENTS

| | | | | | |
|---|---|---|---|---|---|
| 4,588,229 | A | * | 5/1986 | Jay | 297/452.25 |
| 4,643,481 | A | * | 2/1987 | Saloff et al. | 297/452.25 |
| 4,646,374 | A | | 3/1987 | Shafer | 5/653 |
| 4,726,624 | A | * | 2/1988 | Jay | 297/452.25 |
| 4,750,224 | A | * | 6/1988 | Stracke | 5/655.3 |
| 5,029,939 | A | * | 7/1991 | Smith et al. | 5/654 X |
| 5,243,722 | A | * | 9/1993 | Gusakov | 5/655.3 |
| 5,277,474 | A | * | 1/1994 | Hannagan et al. | 5/655.3 X |
| 5,304,271 | A | * | 4/1994 | Gusakov | 156/145 |
| 5,369,828 | A | * | 12/1994 | Graebe | 5/654 |
| 5,378,045 | A | | 1/1995 | Siekman et al. | 297/452.25 |
| 5,390,384 | A | | 2/1995 | Dinsmoor, III et al. | 5/654 |
| 5,395,162 | A | | 3/1995 | Jay et al. | 297/452.25 |
| 5,414,884 | A | * | 5/1995 | Mackenzie | 5/653 |
| 5,461,741 | A | * | 10/1995 | Graebe | 5/654 |
| 5,513,899 | A | * | 5/1996 | Michaels et al. | 5/654 X |
| 5,522,106 | A | | 6/1996 | Harrison et al. | 5/653 |
| 5,551,107 | A | * | 9/1996 | Graebe | 5/654 |
| 5,613,257 | A | * | 3/1997 | Graebe | 5/654 |
| 5,638,565 | A | * | 6/1997 | Pekar | 5/710 |
| 5,671,977 | A | * | 9/1997 | Jay et al. | 297/452.24 |
| 5,687,436 | A | * | 11/1997 | Denton | 5/653 |
| 5,797,155 | A | * | 8/1998 | Maier et al. | 5/654 |
| 5,836,654 | A | * | 11/1998 | DeBellis et al. | 297/452.41 |
| 5,839,140 | A | | 11/1998 | Wilkerson | 5/654 |
| 5,857,749 | A | * | 1/1999 | DeBellis et al. | 297/452.41 |
| 5,918,334 | A | | 7/1999 | Laidlaw | 5/654 |
| 5,933,891 | A | * | 8/1999 | Nachod, III | 5/654 |
| 6,018,832 | A | * | 2/2000 | Graebe | 5/654 |
| 6,036,271 | A | * | 3/2000 | Wilkinson et al. | 297/452.41 |
| 6,161,238 | A | * | 12/2000 | Graebe | 5/648 |
| 6,241,320 | B1 | | 6/2001 | Chew et al. | 297/452.26 |
| 6,327,724 | B1 | * | 12/2001 | Sharrock et al. | 5/654 X |

FOREIGN PATENT DOCUMENTS

| | | | | |
|---|---|---|---|---|
| WO | WO 83003195 A | * | 9/1983 | 297/452.24 |
| WO | WO 93016622 A1 | * | 9/1993 | 5/654 |
| WO | WO 97/45039 | | 12/1997 | |
| WO | WO 99/42070 | | 8/1999 | |
| WO | WO 00/28933 | | 5/2000 | |

* cited by examiner

*Primary Examiner*—Robert G. Santos
(74) *Attorney, Agent, or Firm*—Hudak, Shunk & Farine; Laura F. Shunk

(57) ABSTRACT

The invention relates generally to a seating system and more particularly to seat cushion assemblies having a rearward depression and cushioning insert tailored to fit under the skeletal structure of the user. In particular, the assembly preferably includes an inflatable air insert which is made of a series of pleated air cells where the insert generally has the same outline as the depression. The insert can be inflated during use using a one-handed pump.

21 Claims, 1 Drawing Sheet

SEAT CUSHION AND POSITIONING ASSEMBLY INCLUDING INFLATABLE AIR CELL PRESSURE COMPENSATION INSERT

FIELD OF THE INVENTION

The invention relates generally to a seating system which permits pressure compensation, and more particularly to a seat cushion and positioning assembly which can be tailored to fit the needs of individuals who use wheelchairs.

BACKGROUND OF THE INVENTION

The art of seating has grown to a science involving considerations of physiology, material science, and ergonomics. The present invention relates to a seating assembly designed specifically for individuals confined to a wheelchair with the goal of providing long-term comfort and improved health. Further, the insert of the present invention can be filled to an appropriate pressure to meet individual needs and preferences of a user. While the present invention encompasses multiple aspects, overall goals include maintenance of good health, and comfort of the user. The present invention provides a unique approach and features for posture correction and further services the goal of minimizing the risk of decubitus ulcers.

A first aspect of the invention provides a foam base cushion which is firm but compressible such as provided by an open or closed cell polyurethane foam. The base has a rear depression having a rounded shape which is situated to fit under the user's bottom including ischial tuberosities (i.e. the seat bones) as well as the trochanters of the person seated on the cushion (i.e., "the user").

In a preferred embodiment, the depression has a smoothly spherical or concave surface with the lowest point under and between the ischial tuberosities and which rises gradually upwardly from a gently rounded bottom and blends with the surface of the cushion. Thus, the depression is generally "bowl-shaped". The depression may be hemispherical or may be elongated in the direction of the width of the chair so as to form an ovoid or elliptical shape. The rear depression supports an insert which acts to position the user by supporting the trochanters. The seat bones are ultimately supported by an inflatable top compression insert which has a perimeter shape so as to fit within the rear depression and form a substantially flat appearance in the rear of the cushion. As the user's trochanters are positioned on the air insert, a novel method of positioning is provided in which the skeletal structure of the user is positioned rather than using the prior art reliance on soft tissue. Thus, the present invention provides the advantage of avoiding reliance on soft tissue as a seating support since, in many people who use wheelchairs, the quality and consistency of the muscular tissue is poor.

In a further aspect of the invention, the insert includes a plurality of inflatable pleated air cells which project upwardly from a flat (i.e. planar) bottom. The cells are in fluid communication with each other. The insert is constructed of a flexible material and will correspond generally to or take on the shape of the recess into which it is put. It is important however, that the recess rises upwardly on the sides to provide a proper support for the invalid user.

Moreover, the insert is connected by means of a quick connect fitting to a hand held pump which can be inflated with a single hand, such as a squeezable balloon pump. Thus, the insert can be inflated with a single hand so as to allow the user or a technician to use his or her other hand to check the fill level of the insert. Moreover, the fitting can be a one-way valve as to permit fill while the individual is seated on the cushion. This allows instant input from the user of the cushion during set-up. The insert includes means to affix the insert to the base cushion such as for example adhesive or hook and loop fasteners.

Optionally, the present invention can be used with a bowl shaped intermediate insert also including a seating well which can be positioned between the air filled pressure insert and the base cushion. The use of the intermediate insert enables a positioning which can be further tailored for a particular user. For example, when a user has a scoliosis causing a lateral asymmetry in the pelvic region, the depression can be angled to accommodate or to correct for the problem. This angle can be infinitely adjusted including additional adjustment over time to suit the changing needs of an individual user.

In addition, transverse lateral stabilizers are provided on the bottom side of the cushion and can comprise elongated wedge members having a generally triangular cross-section which support the outer side edges of the cushion from the bottom. The lateral stabilizers or wedges are generally constructed of a material which is stiffer, or more rigid than the base cushion such as closed cell polyurethane foam. Otherwise, the bottom side of the cushion is relatively flat so as to correspond to the shape of a base support of the wheelchair or a rigidizer member which provides a planar surface for sling seats.

The top surface of the base cushion optionally includes contouring such as elevated sides, a front pommel, and ridge so as to define leg wells and rear rims to provide further support to the soft tissue of the user's bottom. These contours may provide additional positioning support for the user.

DETAILED DESCRIPTION OF THE INVENTION

Figure 1:
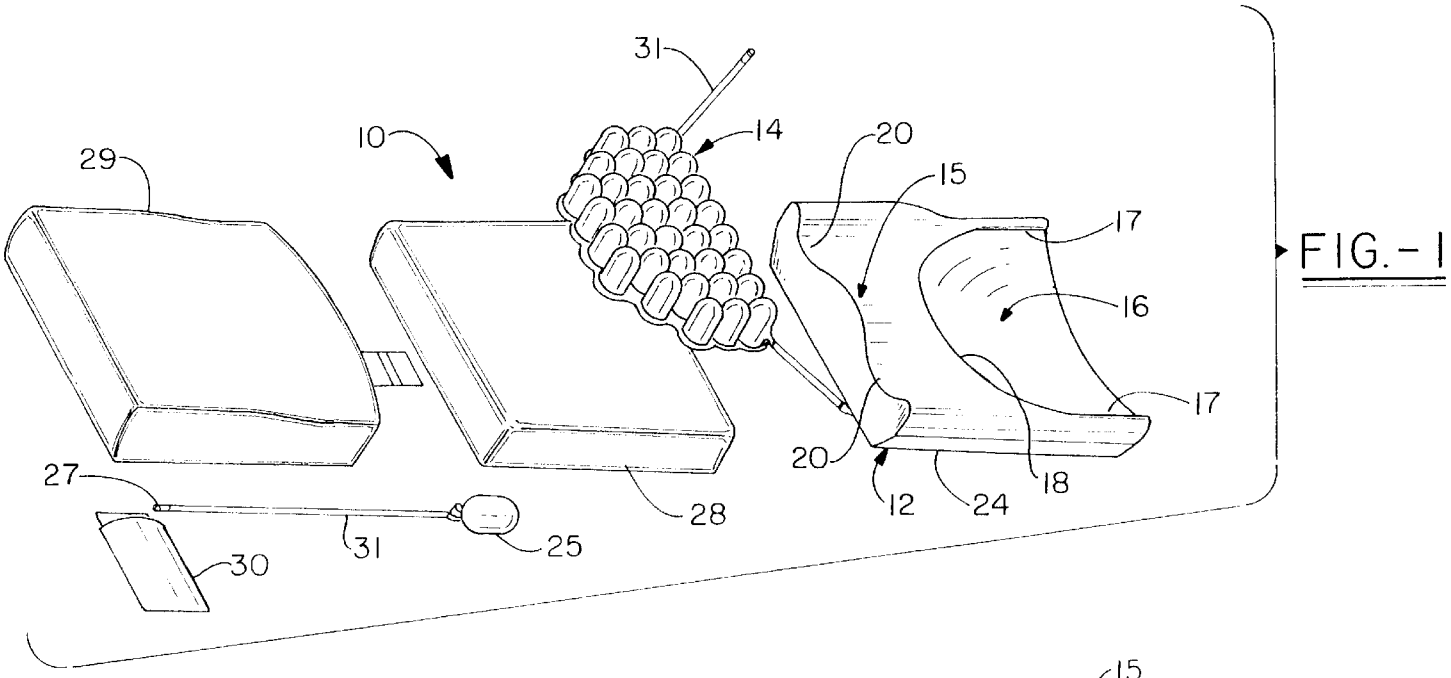
FIG. 1 is an expanded view of cushion assembly in accordance with the invention.
Figure 2:
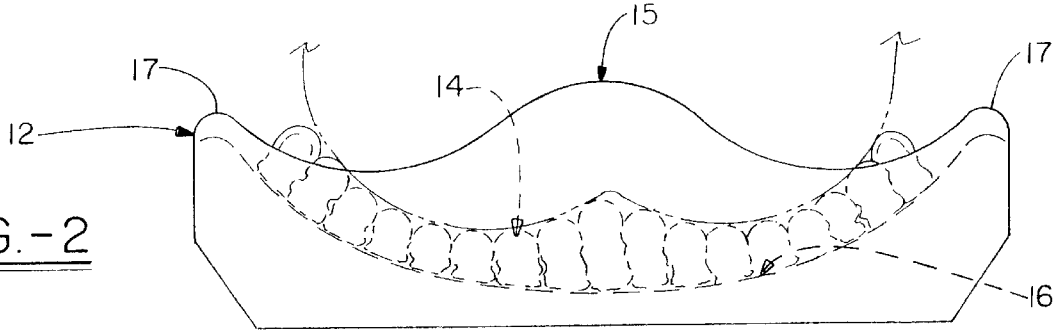
FIG. 2 is a view of the assembly illustrating a user in position.

FIG. 1 represents an exploded view of the cushion assembly in accordance with the invention. The cushion assembly 10 generally comprises a base member 12 and pressure compensation insert 14. The base member has a bowl shaped rear depression 16 on its top surface which cradles the pressure compensation insert 14. The depression is bounded by lateral sidewalls 17 which hold the user and the insert in position, as does the front surface 18 of the bowl. Also on its top surface, base member 12 includes laterally symmetrical channels 20 which are generally mirror images of one another and which are formed to cradle the legs of a person seated in the wheelchair. Thus, the channels are generally in the forward facing portion of the seat relative to the opening of the chair. The channels together define an intermediate rise or pommel 15 which acts to maintain the position of each leg on either side of a central longitudinal axis of the base cushion.

The base cushion also includes a relatively planar bottom surface 24, which is seated on a flat surface of a wheelchair such as a seat base, or on a rigidizer insert in the event that a cushion is used with a sling-type wheelchair.

The cushion is made of a relatively compressible material such as for example closed cell polyurethane foam having a density of about 1–5 pounds per foot$^3$ and a IFD of 20–70 pounds. In contrast, if used lateral stabilizers are made from a relatively incompressible material such as for example rigid polyethylene, although other materials could be used.

The depression 16 in base member is generally an arc where the depth of the depression is approximately three inches and the shape is defined by a radius of about 14 inches. Other curved rounded shapes may also be acceptable. The depression may be open to the rear as shown, or may include a closure such as a rear wall for example for rearward positioning of the insert 14. The insert 14 may further include an intermediate insert made of a foam having compression characteristics similar to the base cushion 12 or depending on the application may be somewhat firmer or less firm. In such case, the intermediate insert has a bottom curve corresponding generally to the shape of the depression in the base cushion 12. In this case, the intermediate insert also includes a positioning well which is generally a rounded configuration such as a hemispherical shape so as to accommodate the air insert.

The seating assembly can be sized for children, small individuals, medium individuals and larger individuals, for example. In general, however, the width of the insert in a transverse direction will be from about 9 to about 14, and more particularly from about 10 to about 12 inches while the length, i.e. in the direction corresponding to the longitudinal axis of the seat, is from about 5 to about 12, more particularly from about 8 to about 10 inches.

The base cushion 12 is a generally compressible material such as a closed or open cell foam preferably open cell polyurethane having a density 1–5 pounds per foot$^3$ and an IFD of about 20–70 pounds, and which is generally formed by molding or sculpting. The cushioning insert should have the characteristics of providing for softer cushioning beneath the ischial tuberosities in order to avoid the formation of decubitus ulcers in this area. In this regard, it is important that the air insert is filled so as to avoid "bottoming out". This occurs when the cushioning material is pushed away from the seat bone such that the bone sits relatively directly on the base cushion, or in the case, on intermediate insert.

As can be seen, the air insert 14 generally has an ordered series of pleated air cells which extend upward from a planar bottom. Appropriate numbers of rows and columns of the cells are provided to fill the bowl shaped depression and the insert has an outline which generally corresponds to the outline of the rear depression. Appropriate air fill means can be used such as a single hand pump 25 connected to a check valve fill tube illustrated at 27. The cushion generally has a depth of about two inches and the insert is filled to a pressure as is dictated by the therapist. A suitable material for constructing the top and bottom is 20 to 200 mil elastomeric film which has been molded to the characteristics described.

In general the assembly is encased in a cover 28, or in this case by two covers 28 and 29 which are moisture impermeable and is stretchable to avoid "hammocking" of the cover. The cover can be opened to the bottom and include an elastic member which secures it around the base, or can be a more traditional cushion cover which has a zip opening. The insert such as the pressure insert, and any additional component such as intermediate inserts or wedges, can be adhered or affixed to the base cushion or other component such as by hook and loop fasteners or glue, or in the case of appropriate materials such as an open foam, friction may be sufficient to hold the components in place relative to each other. The cover also preferably has a pocket 30 for the air pump secured to the cover by detachable means such as by hook and loop fasteners. The air pump is connected to the air insert by means of one or more air conduits 31 with a quick connect one way valve that joins the conduit members.

While in accordance with the patent statues, the best mode and preferred embodiment have been set forth, the scope of the invention is not limited thereto, but rather by the scope of the attached claims.

What is claimed is:

1. A cushion assembly comprising;

a compressible base cushion defining a bowl shaped rear depression which accommodates a cushioning insert, said rear depression having a substantially concave cross sectional shape which includes upwardly sloped opposing lateral side walls and which defines an outline, said cushioning insert comprising a series of inflatable air filled cells which collectively define a bottom surface that assumes the concave shape of the rear depression when the cushioning insert is in place in the rear depression and the insert having an outline corresponding to the outline of the rear depression.

2. An assembly as set forth in claim 1, wherein the bottom surface of said insert is substantially flat when it is placed on a planar surface.

3. An assembly as set forth in claim 2, further comprising a one hand air pump.

4. An assembly as set forth in claim 3, wherein said insert is connected to said pump by a quick connect.

5. An assembly as set forth in claim 1, further including additional positioning support for the assembly user.

6. An assembly as set forth in claim 5, wherein said additional positioning support includes an intermediate insert that includes the rear depression.

7. An assembly as set forth in claim 5, wherein the additional positioning support includes at least one transverse lateral stabilizer.

8. An assembly as set forth in claim 5, wherein the additional positioning support includes a front pommel.

9. An assembly as set forth in claim 5, wherein the additional positioning support includes leg wells.

10. An assembly as set forth in claim 1, wherein the air cells are pleated.

11. A cushion assembly for a wheelchair user comprising;

a firm compressible base cushion defining a bowl shaped rear depression which is from about 9 to about 14 inches wide and from about 5 to about 12 inches long and which contains a cushioning insert, said rear depression having a substantially concave cross sectional shape which includes upwardly sloped opposing lateral side walls, said cushioning insert comprising a series of inflatable pleated air filled cells which extend upward from a planar bottom that assumes the concave shape of the rear depression when the cushioning insert is in place in the rear depression and the insert having an outline corresponding to the outline of the rear depression.

12. An assembly as set forth in claim 11, further comprising a one hand air pump which is used to inflate the cushioning insert.

13. An assembly as set forth in claim 12, wherein said insert is connected to said pump by a quick connect.

14. An assembly as set forth in claim 11, further including additional positioning support for the assembly user.

15. An assembly as set forth in claim 14, wherein said additional positioning support includes an intermediate insert that includes the rear depression.

16. An assembly as set forth in claim 14, wherein the additional positioning support includes at least one transverse lateral stabilizer.

17. An assembly as set forth in claim 14, wherein the additional positioning support includes a front pommel.

18. An assembly as set forth in claim 14, wherein the additional positioning support includes leg wells.

19. A cushion assembly for a wheelchair user comprising;

a firm compressible base cushion defining a bowl shaped rear depression which contains a cushioning insert, said rear depression having a substantially concave cross sectional shape which includes upwardly sloped opposing lateral side walls, said cushioning insert comprising a series of inflatable air filled cells which extend upward from a planar bottom that assumes the concave shape of the rear depression when the cushioning insert is in place in the rear depression and the insert having an outline corresponding to the outline of the rear depression; and said cushioning insert being connected to a one hand air pump.

20. A cushion assembly as set forth in claim 19, wherein said air pump is connected by a check valve to the cushioning insert.

21. A cushion assembly as set forth in claim 20, wherein the base cushion and the cushioning insert are contained in a cover which further includes a pocket for the air pump.

* * * * *